US011464345B2

(12) United States Patent
Edling

(10) Patent No.: US 11,464,345 B2
(45) Date of Patent: Oct. 11, 2022

(54) FIRMNESS CONTROLLING APPARATUS FOR A BED OR SEATING ARRANGEMENT

(71) Applicant: Starsprings AB, Herrljunga (SE)

(72) Inventor: Kenneth Edling, Herrljunga (SE)

(73) Assignee: STARSPRINGS AB, Herrljunga (SE)

( * ) Notice: Subject to any disclaimer, the term of this patent is extended or adjusted under 35 U.S.C. 154(b) by 343 days.

(21) Appl. No.: 16/449,525

(22) Filed: Jun. 24, 2019

(65) Prior Publication Data

US 2019/0387895 A1 Dec. 26, 2019

(30) Foreign Application Priority Data

Jun. 25, 2018 (EP) ..... 18179629

(51) Int. Cl.
*A47C 7/30* (2006.01)
*A47C 27/045* (2006.01)
(Continued)

(52) U.S. Cl.
CPC ..... *A47C 27/0456* (2013.01); *A47C 27/061* (2013.01); *A47C 27/14* (2013.01)

(58) Field of Classification Search
CPC ..... A47C 27/061; A47C 27/30; A47C 27/28; A47C 27/0435; A47C 7/30; A47C 7/285
See application file for complete search history.

(56) References Cited

U.S. PATENT DOCUMENTS 3,273,877 A * 9/1966 Geller ..... B60N 2/72 267/89
3,340,548 A 9/1967 Janapol
(Continued)

FOREIGN PATENT DOCUMENTS

AU 551300 B2 4/1986
CN 201683446 U 12/2010
(Continued)

OTHER PUBLICATIONS

European Search Report for European Patent Application No. 18179629 dated Aug. 23, 2018.
(Continued)

*Primary Examiner* — Peter M. Cuomo
*Assistant Examiner* — Ifeolu A Adeboyejo
(74) *Attorney, Agent, or Firm* — Harness, Dickey & Pierce, P.L.C.

(57) ABSTRACT

A firmness controlling apparatus for use in a bed arrangement or a seating arrangement is disclosed. The apparatus comprises a rigid frame having two opposed sides, and at least one non-elastic flexible elongate element extending between the two opposed sides. Each end of the non-elastic flexible elongate element is directly or indirectly connected to one of the opposed sides, and at least one of the ends is indirectly connected via an elastic flexible elongate element. A plurality of elongate springs are provided and extend in a flat or curved plane, the ends of each elongate spring being attached to one of the at least one non-elastic flexible elongate elements at two separated connections. A retraction device is arranged to tighten and slack the non-elastic flexible elongate element(s) between the two separated connections, thereby adjusting the distance between the two separated connections of each non-elastic flexible elongate element, and thereby controlling the curvature and height of the elongate springs.

17 Claims, 9 Drawing Sheets

(51) Int. Cl.
*A47C 27/06* (2006.01)
*A47C 27/14* (2006.01)

(56) References Cited

U.S. PATENT DOCUMENTS

| | | | | | |
|---|---|---|---|---|---|
| 3,346,891 | A * | 10/1967 | Cundiff | A47C 23/18 | 5/220 |
| 3,893,198 | A * | 7/1975 | Blair | A61G 7/05707 | 5/699 |
| 4,222,137 | A | 9/1980 | Usami | | |
| 4,667,357 | A | 5/1987 | Fortune | | |
| 5,113,539 | A | 5/1992 | Strell | | |
| 5,769,490 | A * | 6/1998 | Falzon | B60N 2/6673 | 297/284.4 |
| 6,295,676 | B1 * | 10/2001 | Warner | A47C 20/04 | 5/716 |
| 6,402,246 | B1 * | 6/2002 | Mundell | A47C 7/465 | 297/284.4 |
| 6,814,407 | B2 * | 11/2004 | Mundell | B60N 2/6671 | 297/284.4 |
| 2006/0253994 | A1 | 11/2006 | Spinks et al. | | |
| 2008/0201848 | A1 | 8/2008 | Tinke et al. | | |
| 2009/0184551 | A1 | 7/2009 | Samain | | |
| 2011/0004371 | A1 * | 1/2011 | Bullard | B60N 2/6673 | 701/36 |
| 2011/0258772 | A1 | 10/2011 | Verschuere et al. | | |
| 2015/0285431 | A1 | 10/2015 | Slusher, II | | |
| 2016/0015183 | A1 * | 1/2016 | Stjerna | A47C 27/064 | 5/727 |

FOREIGN PATENT DOCUMENTS

| | | | |
|---|---|---|---|
| CN | 102657452 | A | 9/2012 |
| CN | 104981181 | A | 10/2015 |
| CN | 105599656 | A | 5/2016 |
| CN | 107252214 | A | 10/2017 |
| EP | 2245967 | A1 | 11/2010 |
| WO | WO-99/65366 | A1 | 12/1999 |
| WO | WO-2009/120270 | A2 | 10/2009 |

OTHER PUBLICATIONS

Office Action for Chinese Patent Application No. 201980033612.1 dated Nov. 26, 2021.

* cited by examiner

FIRMNESS CONTROLLING APPARATUS FOR A BED OR SEATING ARRANGEMENT

FIELD OF THE INVENTION

The present invention relates to a firmness controlling apparatus for use in a bed or seating arrangement, and a bed or seating product having such a firmness controlling device. In particular, the firmness controlling apparatus may provide at least one zone with adjustable firmness in the bed or seating arrangement.

BACKGROUND OF THE INVENTION

In a bed arrangement, a support is provided to act on the weight or part of the weight of a user, wherein the bed distributes the weight from the body of the user over a part of a surface of the device. Depending on how the bed distributes the weight of the user, the bed will appear as being either soft or firm. The degree of firmness of such a bed is dependent on the properties of the elastic elements, such as the spring constant, and how the elastic members have been mounted in the bed, such as the degree of clamping or pre-tensioning. Thus, the firmness of the bed is normally set at the manufacturing of the device.

However, different persons wish and require different firmness. Further, different body parts may require different firmness.

It is known to provide bed arrangements with variable firmness. By inducing deformation to the elastic members to different degrees, the firmness of the device is adjustable. The deformation member has the ability to deform the elastic member independently from the deformation of the elastic member induced by the being. This means that the firmness of the bed is adjustable during initialization, according to the wishes of the user. It is also possible to compensate the firmness of the device for possible changes in the elastic properties of the elastic arrangement over time. Still further, it is known to vary the firmness independently in various zones/sections in a mattress.

Such known solutions are e.g. disclosed in EP 2 245 967 and WO 2009/120270. Both these documents also disclose the possibility of sensing the pressure being applied on different zones, and to control the firmness of different zones automatically, in order to lower the overall pressure.

Further, it is known to provide variation in firmness of a mattress by arranging coil springs on support plates having variable height. The height of the support plates may be controlled by rotatable elements arranged under the support plates, and having an off-centre rotation axis. Hereby, by rotation of the rotatable elements, the plates assume various height positions. Such firmness adjustment means are e.g. discussed in U.S. Pat. No. 3,340,548 and US 2011/0258772. It is also known to use a similar arrangement with support plates having variable height where the height of the support plates may be controlled by displacement members in the form of linear motors, jacks, and other types of lifting mechanism. Such firmness adjustment means are e.g. discussed in AU 55 13 00, U.S. Pat. No. 4,222,137, US 2006/0253994, WO 99/65366 and EP 2 245 967.

It is also known to provide zones having variable firmness realized by inflatable elements, in which the pressure is independently variable by means of pressurization means. Such firmness adjustment means are e.g. discussed in WO 2009/120270.

Further, it is known to realize mattresses with variable firmness by a combination of inflatable elements and other resilient elements, such as coil springs, as is e.g. discussed in U.S. Pat. No. 5,113,539.

May other firmness adjustment means are also feasible, such as by arranging threads through the mattress, whereby the height position and/or tension is variable, such as is e.g. discussed in U.S. Pat. No. 4,667,357.

However, common problems with these previously known bed arrangements with variable firmness are that they are relatively complex, heavy and costly to produce. Further, these known bed arrangements are also often relatively difficult and cumbersome to use. Further, even though these known bed arrangements provide a certain degree of adjustability, this is often inadequate for the users' needs.

It is therefore still a need for a firmness control apparatus and a bed or seating arrangement with adjustable firmness which alleviates the above-discussed problems.

SUMMARY OF THE INVENTION

It is therefore an object of the present invention to at least partly overcome these problems, and to provide an improved firmness controlling apparatus, and bed and seating arrangement.

These, and other, objects that will be apparent from the following, are achieved by a firmness controlling apparatus, and a bed and seating arrangement, according to the appended claims.

According to a first aspect of the invention, there is provided a firmness controlling apparatus for use in a bed arrangement or a seating arrangement, the firmness controlling apparatus comprising:

a rigid frame having two opposed sides;

at least one non-elastic flexible elongate elements extending between the two opposed sides, each non-elastic flexible elongate element being provided with two ends, wherein each end of the non-elastic flexible elongate element is directly or indirectly connected to one of the opposed sides, and wherein at least one of the ends of each non-elastic flexible elongate element is indirectly connected to one of the opposed sides via an elastic flexible elongate element;

a plurality of elongate springs extending in a flat or curved plane, each elongate spring having two ends, the ends of each elongate spring being attached to one of the non-elastic flexible elongate element(s) at two separated connections; and a retraction device arranged to tighten and slack the at least one non-elastic flexible elongate element between said two separated connections, thereby adjusting the distance between the two separated connections of each non-elastic flexible elongate element, and the curvature and height of the elongate springs.

The new firmness controlling apparatus is very cost-effective to produce, and can be used with a wide variety of mattresses, arranged to overly or surround the firmness controlling apparatus, as discussed in more detail in the following. The firmness controlling apparatus is essentially flat, and can be arranged underneath any type of mattress, and may also be provided beneath a mattress and a bed or seat bottom plate, and/or be arranged between an upper and lower mattress.

The sleeping experience, and what is considered comfortable and not, varies greatly from person to person. Further, a user often may find it more comfortable to have a softer mattress when using one lying position, such as on the stomach, i.e. in a prone position, or on the side, than when resting in other sleeping positions, such as on the back, i.e. in supine position. The present invention provides an efficient, yet relatively simple and cost-efficient, way of varying the mattress properties in dependence of the user's wishes, and e.g. based on the choice of lying position. It has been found that this greatly improves the sleeping and resting experience, which provides better resting and sleeping quality. Improved sleep and rest also improves the health of the user, and overall leads to an improved quality of life.

Prior to the present invention, mattresses and beds with adjustable properties were known to be complex, heavy and costly, and also difficult and cumbersome to use. In contrast, the present invention provides a bed arrangement with adjustable properties which weighs very little, is relatively simple and cost-efficient to produce, which is easy to operate for the user, and which is easy to modify, e.g. for using more or fewer adjustable zones. The bed arrangement also lends itself very well for automated or semi-automated manufacturing.

Since the firmness controlling apparatus comprises very few relatively inexpensive parts, it is producible to a low cost. The firmness controlling apparatus can be arranged on new bed or seating arrangements, but may also easily be retrofitted on existing bed or seating arrangements.

The new firmness controlling apparatus has also been found to be very efficient in providing a wide range of continuously variable firmness, and with a very precise and reliable controllability. Thus, one or several firmness controlling apparatus may be provided in a bed or seating arrangement, to provide variable firmness in one or several zones of the mattress.

It has been found that by a low or moderate variation of the length of the non-elastic flexible elongate element(s), considerable variations in firmness properties are obtained. The firmness is also controllable in a very precise and predictable way.

By "rigid frame" is in the context of the present invention meant a frame which is sufficiently rigid in the plane of the frame to withstand the forces from the elongate springs, and the flexible elastic and non-elastic elongate elements, both when the elongate springs are contracted and relaxed. The rigidity of the frame is preferably such that the frame is not significantly deformed due to such forces. However, the rigid frame may still be flexible in other directions, such as in directions normal to the plane of the frame. Hereby, the rigid frame may be bent, e.g. when the mattress is rolled-up and vacuum packed to a very compact format, for shipping, storage and the like. Thus, the firmness controlling apparatus hereby enables very compact packaging, which is of great importance.

The rigid frame may e.g. be made of steel bands, or bands made of other materials, and having a thickness in a direction perpendicular to the frame plane which is much lower than the width, extending in the frame plane. The thickness may e.g. be in the range 0.5-2 mm, and the width may be in the range 4-10 mm.

The non-elastic flexible elongate elements are preferably provided in the form of straps or cords, and preferably of a pliable but non-elastic material.

Only a few, such as two, non-elastic flexible elongate element may be provided. In this case, the non-elastic flexible elongate element is preferably relatively wide, preferably extending over a substantial part of the width of the variable zone, such as extending over more than 15% of the width of the variable zone, and even more preferred extending over more than 25%. However, preferably at least three, four or more parallel non-elastic flexible elongate elements are arranged to extend underneath each of said variable zone(s).

In one embodiment, there is as many flexible non-elastic elongate elements as the number of elongate springs, so that each elongate spring may be connected with a separate flexible elongate element. In such an embodiment, the width of the flexible non-elastic elongate elements may be the same or similar to the width of the elongate springs. However, it is also possible to connect two or more elongate springs to a common, single flexible non-elastic elongate element. In one such embodiment, all the elongate springs may be attached to a common, single flexible non-elastic elongate element. In such an embodiment, the flexible non-elastic elongate element preferably has a width widely exceeding the width of each elastic springs, and preferably extending over essentially the whole width of the firmness controlling apparatus. In this case, the single flexible non-elastic elongate element may be connected to the frame via a single flexible elastic elongate element, or by multiple flexible elastic elongate elements.

Since at least one of the ends of each non-elastic flexible elongate element is indirectly connected to one of the opposed sides of the frame via an elastic flexible elongate element, the total length of the elastic and non-elastic flexible elongate elements may remain constant during contraction and relaxation of the non-elastic flexible elongate elements. The elastic flexible elongate elements also ensure that the non-elastic flexible elongate element at all times remains under some tension, thereby maintaining the non-elastic flexible elongate element in a relatively straight configuration, and also pulls the ends of the non-elastic flexible elongate element apart when the non-elastic flexible elongate element is relaxed.

In one embodiment, only one of the ends of the non-elastic flexible elongate element is indirectly connected to one of the opposed sides. If all the non-elastic flexible elongate elements are connected by elastic elongate elements at the same side, the point of increased firmness will vary slightly towards the directly connected end when the firmness is increased. However, for many applications, this is fully acceptable. Further, some of the non-elastic flexible elongate elements may be directly connected to one of the opposed sides, whereas others are directly connected to the other of the opposed sides. Hereby, the variation of the point of increased firmness will be evened out between the non-elastic flexible elongate elements. In one preferred embodiment, every other non-elastic flexible elongate element is connected to one of the opposed sides, whereas every other non-elastic flexible elongate element is connected to the other of the opposed sides.

However, in an even more preferred embodiment, both ends of each non-elastic flexible elongate element are indirectly connected to one of the opposed sides via elastic flexible elongate elements. Hereby, the point of increased firmness will remain at the same position at all time during increase and decrease of the firmness.

The non-elastic flexible elongate elements may be realized in various ways, such as by metal wires, ropes, etc. However, preferably, the non-elastic elongate elements are tape-like, having a width exceeding the thickness. In one embodiment, the non-elastic flexible elongate elements are straps made on non-elastic flexible fabric.

Similarly, the elastic flexible elongate elements may be realized as elastic cords, coil springs and the like. However, preferably, the non-elastic elongate elements are tape-like, having a width exceeding the thickness. In one embodiment, the elastic flexible elongate elements are straps made of elastic flexible fabric.

The retraction device may be arranged beneath a plane in which the non-elastic flexible elongate elements extend. For example, the retraction device may be arranged to pull down the non-elastic flexible elongate elements, e.g. between two rollers, sliding surfaces, or the like.

However, alternatively, the retraction device may be arranged essentially in a plane in which the non-elastic flexible elongate elements extend. For example, the non-elastic flexible elongate elements may be connected to a rotatable rod, shaft or the like, connected to a rotation motor/pump or the like, whereby rotation of the rod/shaft in one direction pulls in the non-elastic flexible elongate elements, and in the other direction releases the non-elastic flexible elongate elements.

The non-elastic flexible elongate elements are preferably all operated by a single retraction means, controlling all the non-elastic flexible elongate elements at the same time and in the same way. Such a solution is very cost-effective, and simple to realize. However, alternatively, the non-elastic flexible elongate elements may be individually controllable, or sets of non-elastic flexible elongate elements may be controlled separately.

The retraction device is preferably arranged to tighten the non-elastic flexible elongate elements by at least one of rolling up the flexible elongate elements around an shaft/rod, pulling the flexible elongate elements and pushing the flexible elongate elements.

The retraction device is preferably operated by means of at least one of an electric motor and an electric pump. This makes adjustment of the firmness very convenient, e.g. by simply operating a control panel or a remote control. For communication with a control unit controlling the retraction device, a remote control may be used, which is adapted to communicate with the control unit, e.g. through a wireless interface.

However, it is also feasible to provide a mechanical solution, in which the retraction device is operated manually, by rotating a control wheel or the like. For example, a lead screw or translation screw may be used. A knob, wheel or any other type of handle may then be manually rotated, thereby rotating the screw, resulting in a corresponding displacement of the connection of the flexible elongate elements. Other type of manually operable retraction devices are also feasible, such as by providing longitudinally separate holes in the flexible elongate elements, which are releasably connected to holding pins or the like in various displaced positions.

The elongate springs may be realized in various ways. However, in accordance with a preferred embodiment, the elongate springs are at least one of: sinuous springs, such as no-sag springs, and strip springs, such as strip steel springs. Strip springs may also be formed of other elastic materials, such as plastic materials, composite materials, etc. However, sinuous springs are particularly preferred, since they are elastic both in the length direction and in a direction transversal to the length direction.

The sinuous springs preferably have a zigzag pattern and are preferably arranged to have a slight upwardly bending arc between the two connections also in the relaxed disposition, to ensure that the spring flexes upwards and not downwards when the non-elastic flexible elongate elements are contracted.

The endmost segments of the sinuous spring may be secured to the non-elastic flexible elongate elements in any number of ways including inserting the endmost segments of the sinuous springs in loops integrally formed in the flexible elements, attaching them by sewing and the like.

Each length of non-elastic flexible elongate element has an intermediate portion, extending over the entire extension between the connections to the elongate spring, which is not connected to the elongate springs.

According to a second aspect of the invention, there is provided a bed or seating arrangement, comprising at least one firmness controlling apparatus as discussed above, wherein the arrangement further comprises a mattress, wherein the firmness controlling apparatus(es) is/are arranged underneath the mattress.

The mattress is preferably a pocket spring mattress, comprising a plurality of strings of a casing material, each string defining a plurality of pockets and each pocket comprising a coil spring.

The firmness controlling apparatus may be arranged beneath the pocket spring mattress, thereby providing a increased pressure from below on certain of the pockets, thereby increasing the firmness of these pockets.

However, alternatively, the mattress may comprise at least one cut-out portion arranged overlying the firmness controlling apparatus. This cut-out portion may be empty, only to be wholly or partly filled by the elongate springs when contracted. In such an embodiment, the cut-out portions are preferably arranged only overlying the elongate springs of the firmness control apparatus, and with pockets of the mattress being arranged therebetween.

However, the cut-out portion may also comprise a mattress insert arranged above the firmness control apparatus, to provide an even surface of the mattress, and to even out the increased and decreased firmness when the elongate springs are contracted and relaxed, respectively.

The bed or seating arrangement may also comprise an additional layer arranged on top of the mattress, in particular if cut-outs is provided in the mattress, in order to increase comfort and provide a smooth and planar upper surface. This additional layer may comprise a padding layer, and/or a layer of fabric, and preferably a stretchable fabric. Alternatively, or additionally, the additional layer may also comprise an additional, upper mattress. The upper mattress may be of the same type as the lower mattress, such as also being of a pocket spring mattress type. The upper mattress may have the same size as the lower mattress, but may, alternatively, be thinner. The upper mattress preferably extends over the entire surface of the lower mattress, and is preferably free from cut-outs and the like.

In one embodiment, the insert comprises a pocket spring mattress insert. However, the insert may also comprise a foam insert. The foam insert may be provided with one or several concavely curved interior surfaces overlying the elongate springs of the firmness controlling apparatus.

The bed or seating arrangement may comprise one firmness controlling apparatus, to provide one zone of variable firmness. However, alternatively, it may further comprise at least two zones having variable firmness, and at least one firmness controlling apparatus provided at each zone.

The firmness controlling apparatus preferably has a width extension exceeding 50% of the width of the mattress, and preferably exceeding 75%, and a length extension being less than 50% of the length of the mattress, and preferably less than 25%.

The variable zone(s) preferably extend(s) over essentially the whole width of the upper mattress. In case several zones are provided, the zones are preferably separated in a longitudinal direction of the mattress. Since the same firmness is usually requested, regardless of the whether the user lies in the centre, or towards one of the sides, there is usually no need to separate the zones in the width direction. However, in case the bed arrangement is to be used by more than one person simultaneously, or if there is a need to distinguish between different lateral positions for other reasons, zones having variable firmness being separated also in the width direction may be used. In this case, it is e.g. feasible to use two separate, and independently operable firmness control apparatuses, and e.g. a common upper mattress arranged above these two firmness control apparatuses.

The bed arrangement preferably comprises at least two zones, of which at least one constitutes a variable zone.

Further, the bed arrangement preferably has at least two variable zones, and at least one firmness controlling apparatus for each of said variable zone, independently operable to control the firmness of said zones. More than two variable zones may also be provided, such as three, five or seven. For example, different zones with variable firmness may be provided at least for the user's hip part and shoulder part. Such zones may be provided also for the user's feet part and head part. In between these zones, zones being provided with a constant firmness may be provided. However, alternatively also these zones may have a variable firmness. Thus, in more refined embodiments, 7, 10 or even more zones with variable firmness may be provided.

By means of these additional aspects of the invention, similar objects and advantages as discussed above in relation to the first aspect of the invention are obtainable.

BRIEF DESCRIPTION OF THE DRAWINGS

For exemplifying purposes, the invention will be described in closer detail in the following with reference to embodiments thereof illustrated in the attached drawings, wherein.

DETAILED DESCRIPTION

Figure 1:
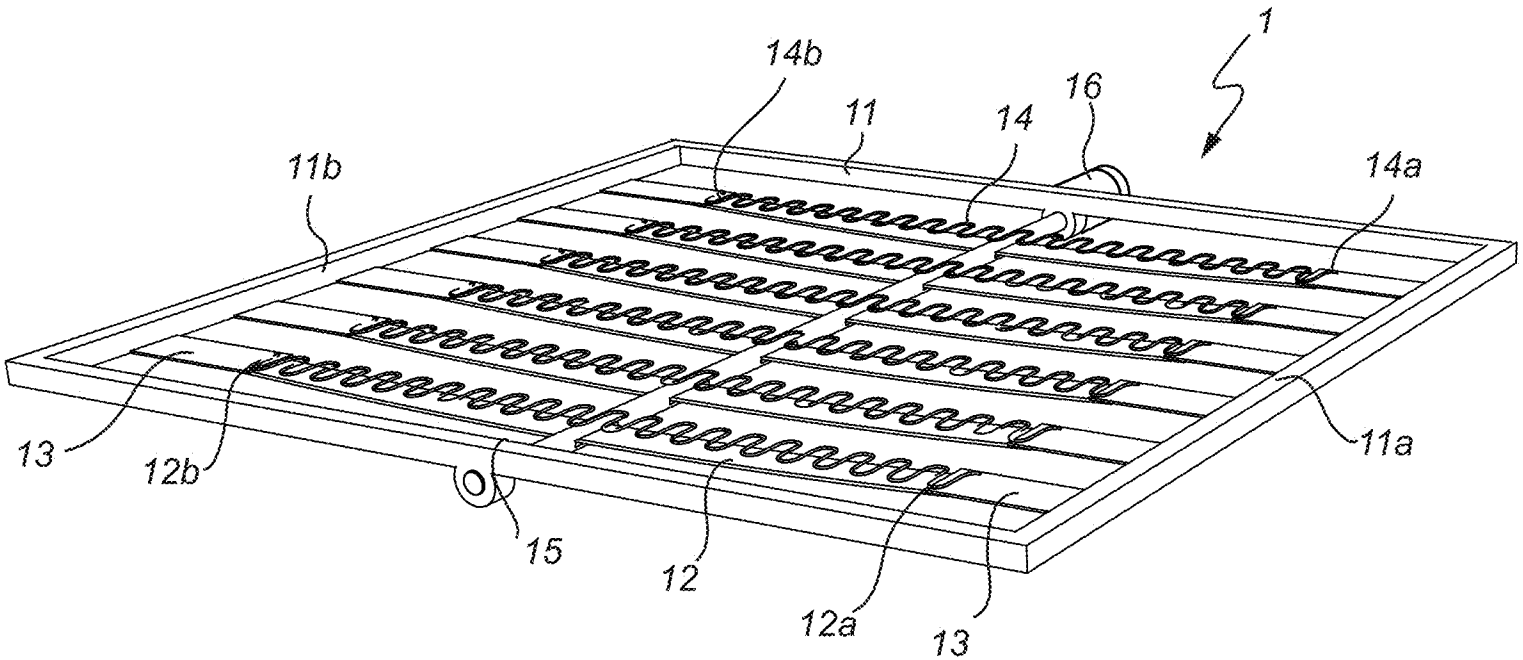
FIG. 1 shows a schematic perspective view of a firmness control apparatus in a relaxed state according to an embodiment of the present invention.
Figure 2:
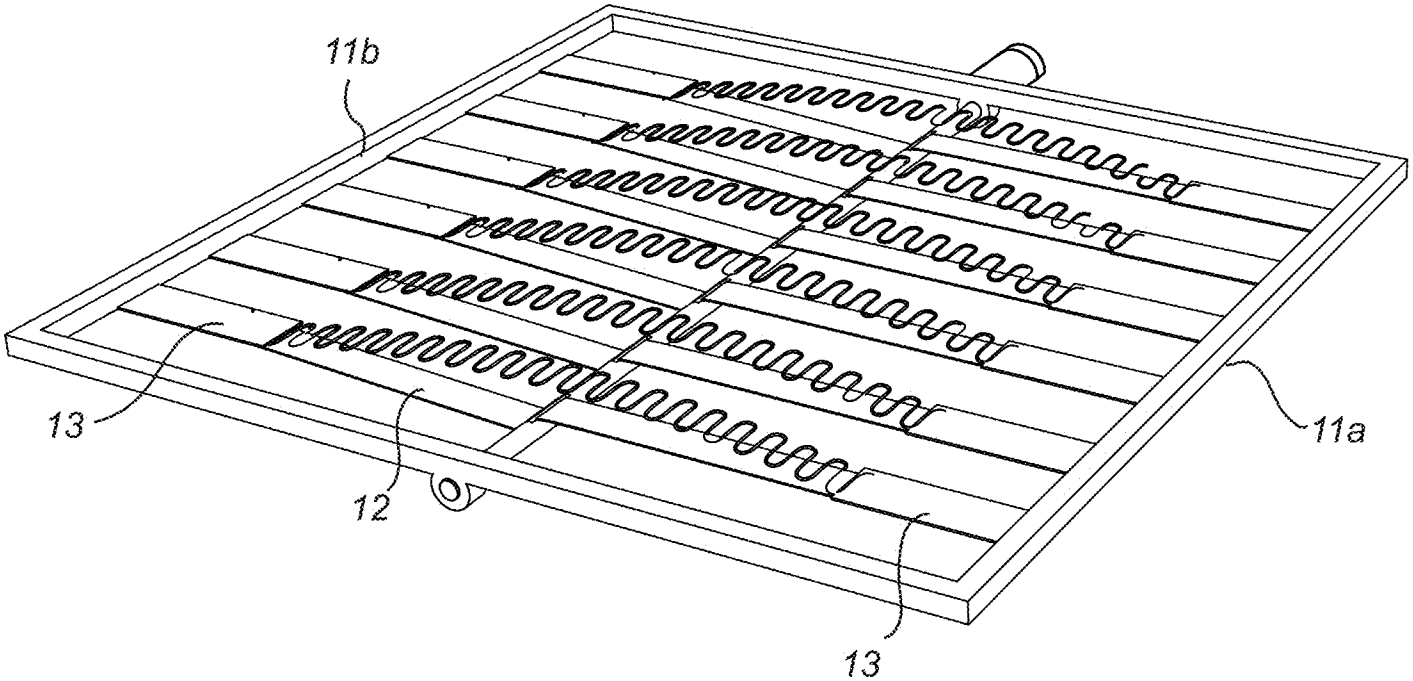
FIG. 2 shows a schematic perspective view of the firmness control apparatus of FIG. 1 in a slightly contracted state.

In the following detailed description preferred embodiments of the invention will be described. However, it is to be understood that features of the different embodiments are exchangeable between the embodiments and may be combined in different ways, unless anything else is specifically indicated. It may also be noted that, for the sake of clarity, the dimensions of certain components illustrated in the drawings may differ from the corresponding dimensions in real-life implementations of the invention, e.g. the length of the elongate springs, etc. Further, even though the specific embodiments to be discussed in the following are primarily related to bed arrangements, the firmness controlling apparatus, possibly with slightly different dimensions, may also be used for seating arrangements and the like.

A first embodiment of a firmness controlling apparatus 1 is illustrated in FIGS. 1-4. The firmness controlling apparatus may be used in a bed arrangement or a seating arrangement, as will be discussed in further detail in the following. The firmness controlling apparatus 1 comprises a rigid frame 11 having two opposed sides 11*a* and 11*b*. The frame may e.g. be rectangular in shape, where the two opposing sides 11*a* and 11*b* may be the two sides along the length direction of the rectangle, or the two sides along the width direction. The frame may be made of metal, such as steel, but may alternatively be made of wood, plastic material, or the like.

The firmness controlling apparatus further comprises a plurality of non-elastic flexible elongate elements 12 extending between the two opposed sides 11*a* and 11*b*. The non-elastic flexible elongate elements 12 may e.g. be in the form of non-elastic straps, having a width widely exceeding the thickness. Each non-elastic flexible elongate element 12 is provided with two ends 12*a* and 12*b*, and each of these ends 12*a*, 12*b* are directly or indirectly connected to one of the opposed sides 11*a*, 11*b*. At least one of the ends 12*a*, 12*b* of each non-elastic flexible elongate element 12 is indirectly connected to one of the opposed sides 11*a*, 11*b* via an elastic flexible elongate element 13. In the illustrative example, both ends 12*a*, 12*b* of each non-elastic flexible elongate element 12 are indirectly connected to one of the opposed sides 11*a*, 11*b* via such an elastic flexible elongate element 13. Thus, one end of each elastic flexible elongate elements is connected to the frame, whereas the other is connected to an end of a non-elastic flexible elongate element 12.

The non-elastic flexible elongate elements 12 may be made of non-elastic fabric, but may alternatively be made wholly or partly of metal and the like. The non-elastic flexible elongate elements may be in the form of straps, i.e. having a tape-like form, as in the illustrative embodiment. However, they may alternatively be in the form of cords, wires and the like.

The elastic flexible elongate elements 13 may be made of elastic fabric, such as stretch fabric, but may also be in the form of rubber bands, elastic ribbons, etc. Alternatively, the elastic flexible elongate elements 13 may comprise springs, such as elongate and preferably relatively thin coil springs, etc.

A non-elastic flexible elongate element 12 may, at one or both ends, be connected to more than one elastic flexible elongate element 13, such as two elastic flexible elongate elements 13, preferably separated in the longitudinal direction of the opposing frame sides 11*a*, 11*b*. Similarly, an elastic flexible elongate element 13 may be connected to more than one non-elastic flexible elongate element 12, such as two non-elastic flexible elongate elements 12, preferably separated in the longitudinal direction of the opposing frame sides 11*a*, 11*b*. Such realizations are particularly useful in case the width of the elastic and non-elastic flexible elongate elements differ, such as when the non-elastic flexible elongate elements are in the form of straps and the elastic flexible elongate elements are in the form of cords, or vice versa.

The firmness controlling apparatus further comprises a plurality of elongate springs 14 extending in a flat or curved plane. The elongate springs 14 are preferably sinuous springs, such as no-sag springs, as shown in the exemplary embodiment of FIGS. 1-4. However, the elongate springs may alternatively be realized in other ways, such as strip springs, such as strip steel springs. All the elongate springs are preferably of the same type. However, a combination of elongate springs of different types are also feasible.

Each elongate spring 14 has two ends 14*a* and 14*b*, and each of the ends 14*a*, 14*b* is attached to one of the non-elastic flexible elongate elements at two separated connections. Preferably, the ends 14*a* are preferably connected at or in the vicinity of the ends 12*a* of the non-elastic flexible elongate elements, and the ends 14*b* are preferably connected at or in the vicinity of the ends 12*b* of the non-elastic flexible elongate elements. The remainder of the elongate springs, between the end points 14*a* and 14*b* are preferably unconnected to the non-elastic flexible elongate elements.

The ends of the elongate springs can be connected to the non-elastic flexible elongate elements, by being inserted into loops formed therein, or in other ways, such as by sewing, adhesion, bolts, rivets, etc.

Figure 3:
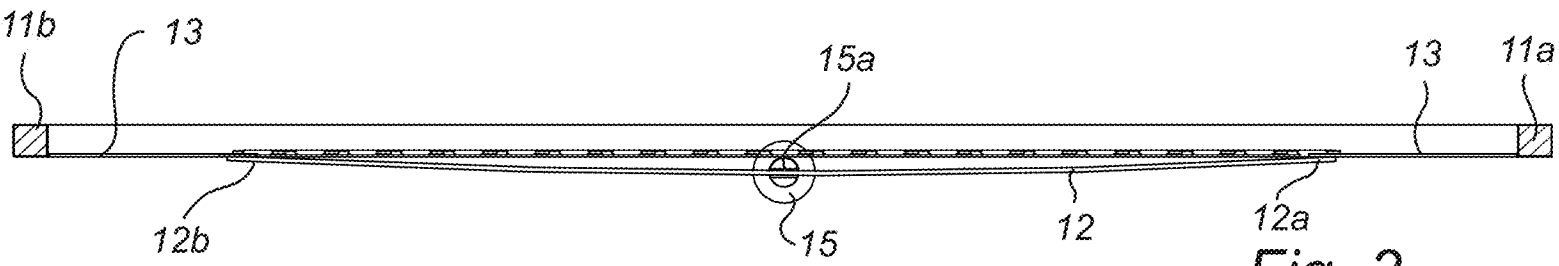
FIG. 3 shows a cross-sectional side view of the firmness control apparatus of FIG. 1 in a relaxed state.
Figure 4:
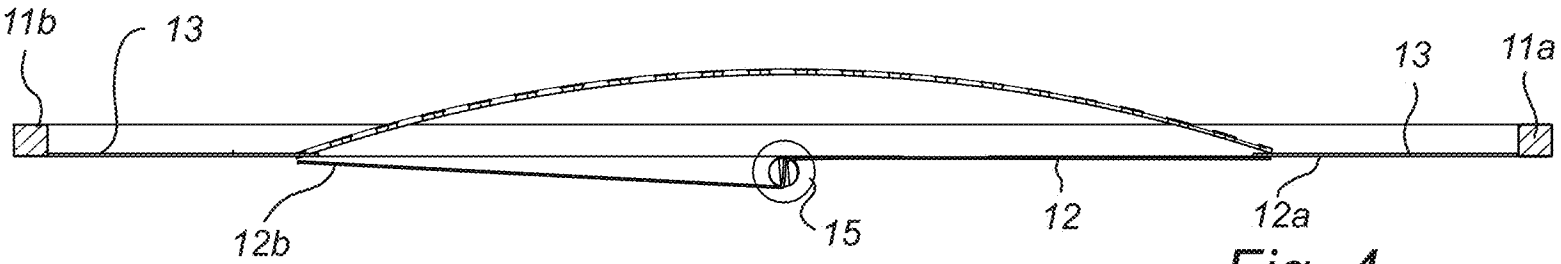
FIG. 4 shows a cross-sectional side view of the firmness control apparatus of FIG. 1 in a contracted state, with a retraction device arranged in the same plane as the non-elastic flexible elongate elements.

A retraction device 15 is arranged to tighten and slack the non-elastic flexible elongate elements 12 between the two separated connections. In the embodiment illustrated in FIGS. 1-4, the retraction device 15 is arranged essentially in a plane in which the non-elastic flexible elongate elements extend. The retraction device here comprises a rotatable shaft 15*a* with an opening through which the non-elastic flexible elongate element 12 extends. By rotating the shaft, the non-elastic flexible elongate element is rolled up on the shaft, thereby decreasing the distance between the connections. Hereby, the ends 14*a* and 14*b* of the elongate springs are pulled together, whereby the elongate springs 14 protrudes in an arc upwards. The more the shaft 15*a* is rotated, the higher the arc becomes. If the shaft is rotated in the different direction, the height of the arc instead decreases. Thus, the height of the arc can easily be controlled by rotation of the shaft in either of the two directions. This is illustrated in FIGS. 3 and 4, where FIG. 3 shows the elongate spring in a lowered, relaxed position, and FIG. 4 shows the elongate spring in a somewhat contracted, tensed position, in which the elongate spring forms an arc upwards.

The shaft 15*a* can be controlled manually, e.g. by being operable by a crank or the like. However, it can also be operated by an automated drive unit 16, e.g. a pump, an electric motor, or the like.

Figure 5:
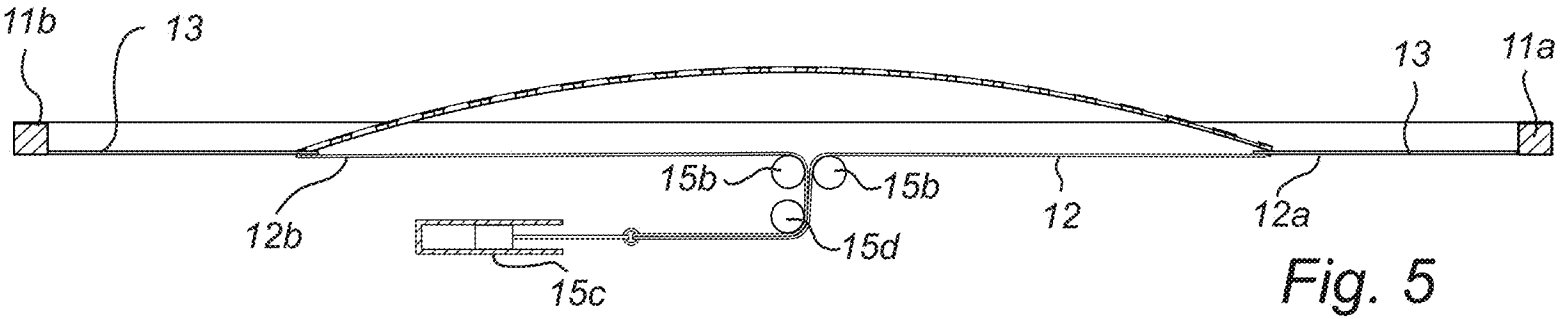
FIG. 5 shows a cross-sectional side view of the firmness control apparatus of FIG. 1 in a contracted state, with a retraction device arranged beneath the non-elastic flexible elongate elements.

The non-elastic flexible elongate elements may also be retracted in other ways. One such alternative is illustrated in FIG. 5, where the non-elastic flexible elongate elements 12 are led downwards via two rollers 15*b* or sliding surfaces. The non-elastic flexible elongate elements may then be pulled downwardly by a plunger 15*c* or the like. The pulling may occur downwardly, but may also occur in the plane of the frame, e.g. by being led via a further roller 15*d*, as shown in the illustrative example. In this embodiment, the retraction device is arranged beneath the plane in which the non-elastic flexible elongate elements extend. The plunger may be operated manually or automatically, e.g. by being connected to an electrical pump.

Figure 6:
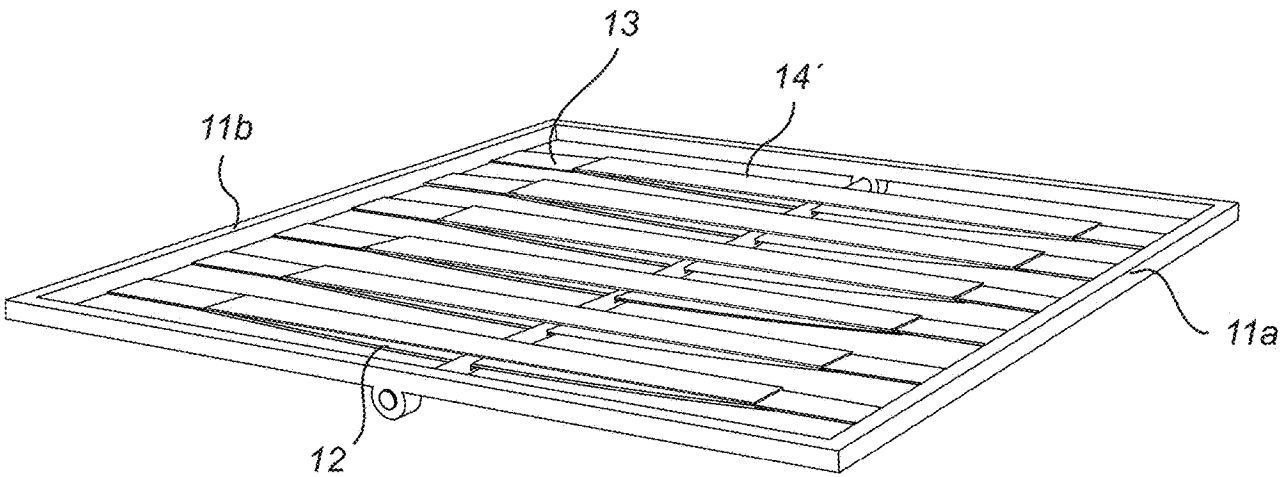
FIG. 6 shows a schematic perspective view of another embodiment of a firmness control apparatus according to the present invention.
Figure 7:
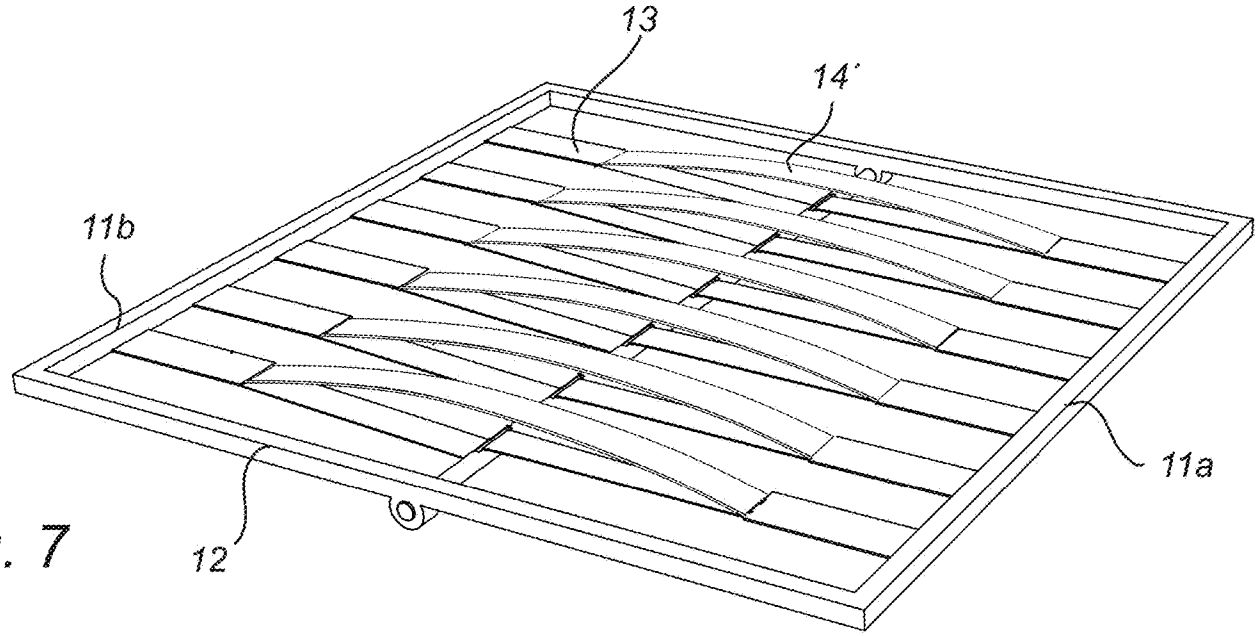
FIG. 7 shows a schematic perspective view of the firmness control apparatus of FIG. 6 in a slightly contracted state.

In FIGS. 6 and 7, another embodiment of the firmness controlling apparatus is illustrated. Here, the elongate springs are formed as strip springs, such as strip steel springs. Apart from this difference, the firmness controlling apparatus as shown in FIGS. 6 and 7 is made essentially in the same way as the one discussed in relation to FIGS. 1-4, and operates in the same way. FIG. 6 shows the elongate springs in a relaxed, lowered position, and FIG. 7 shows the elongate springs in a somewhat tensed, contracted position, in which the elongate springs extends as an arc upwards.

The retraction device when automated may e.g. be controlled by means of a remote control, which may be connected by wireless or wired connection to the drive unit.

The firmness controlling apparatus may be used in combination with a mattress or cushion to form a bed or seating arrangement with variable firmness in one or several zones. The firmness controlling apparatus is hereby arranged beneath the mattress, e.g. on a bed bottom, or on a lower mattress arranged beneath an upper mattress. Some alternative embodiments of such bed arrangements will now be discussed in some detail, and it is to be appreciated by the skilled addressee that the same or similar arrangements may also be used for seating arrangements.

The bed arrangement has an adaptive firmness, and more specifically comprises at least one zone having independently adjustable firmness. The bed arrangement may comprise a single zone, or two or more zones. Further, in case several zones are used, one or more zones may be variable. Further, one or more zones which are non-variable may also be used. For example, different zones with variable firmness may be provided at least for one of the the user's buttock and shoulder. Such zones may be provided also for the user's feet and head. In between and optionally surrounding these zones, zones being provided with a constant firmness may be provided.

Preferably, the zone(s) having independently adjustable firmness extends over at least half of the width of the bed arrangement, and may e.g. extend over essentially the whole width of the bed arrangement.

The mattress may be of various types, such as comprising resilient foam elements, resilient rubber, and the like. However, preferably the mattress comprises a plurality of coil springs, and preferably coil springs arranged in separate pockets of a cover material, to define a pocket spring mattress.

In a pocket mattress realization of the present mattress, at least the parts of the mattress forming zones which do not have variable firmness, and optionally also partly or wholly the zone(s) having variable firmness, are formed as pocket spring mattress. The pocket spring mattress may form an entire, integrated mattress, or be formed be arranged as a separate pocket mattresses assembled together.

Figure 8:
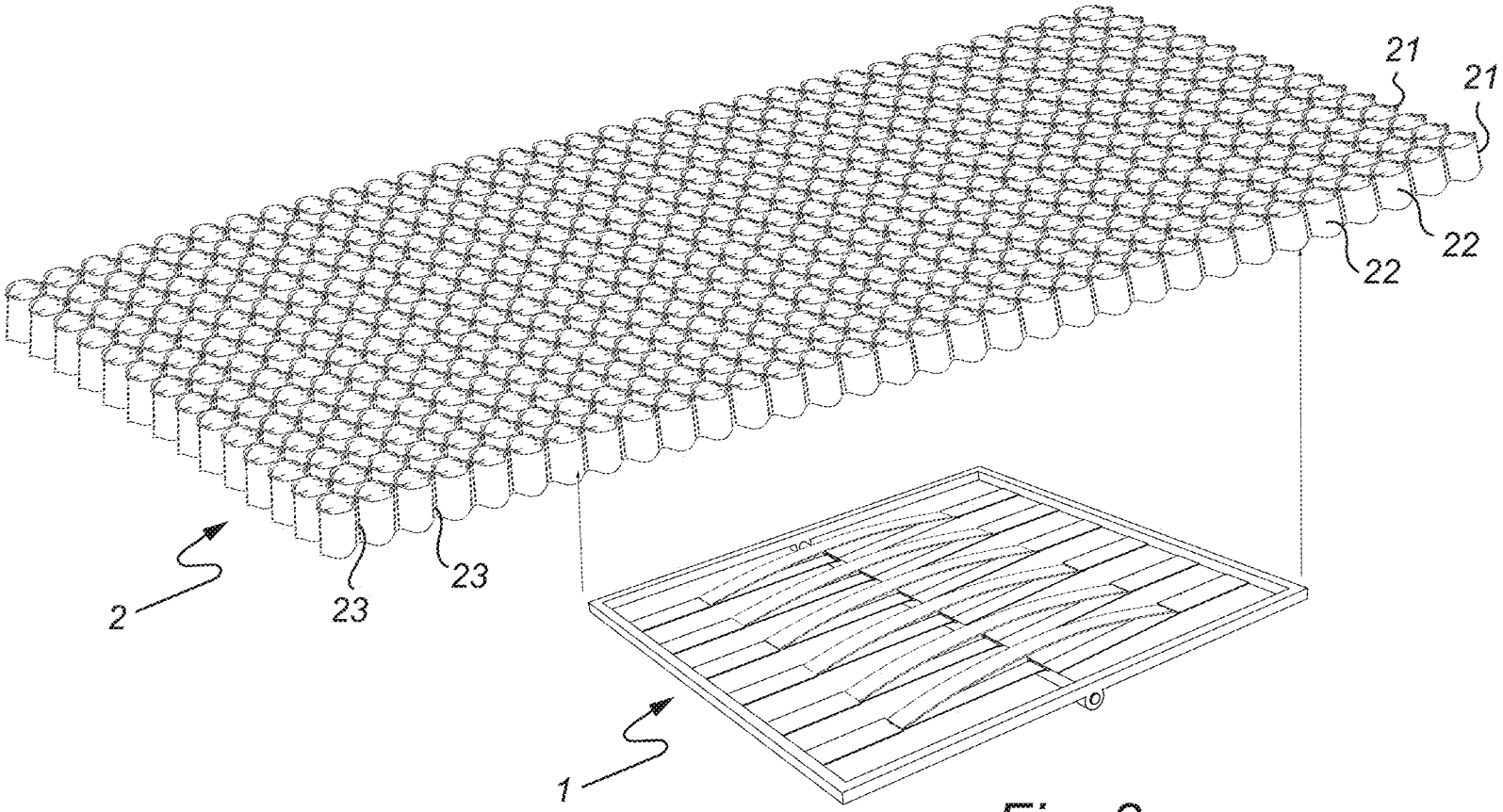
FIG. 8 shows a schematic exploded view in perspective, slightly from above, of a bed arrangement in accordance with an embodiment of the present invention.
Figure 9:
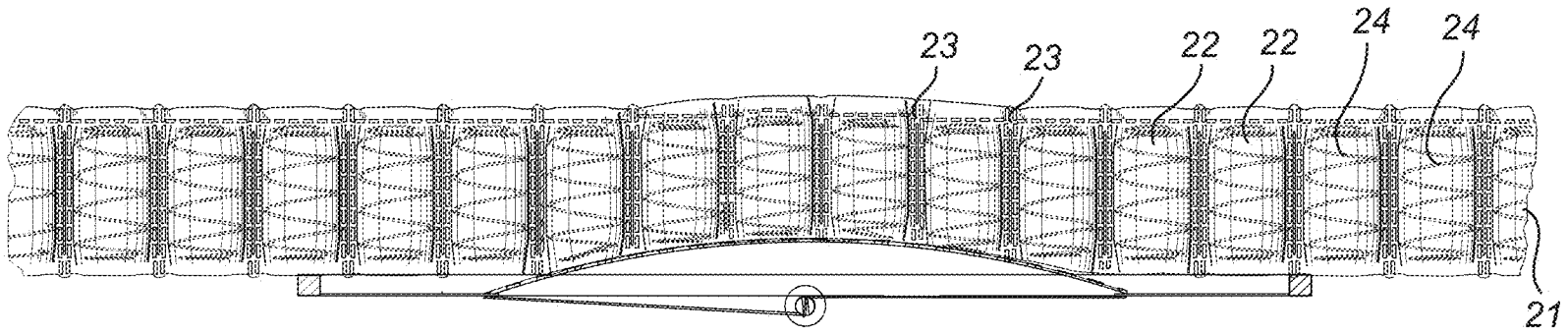
FIG. 9 shows a cross-sectional side view of the bed arrangement of FIG. 8 in a contracted state.

With reference to e.g. FIGS. 8 and 9, the pocket mattress 2 preferably comprises a plurality of strings 21 interconnected side by side by means of a surface attachment, such as adhesive, welding, Velcro or the like. Each string comprises a plurality of continuous casings/pockets 22, formed by a continuous casing material and the pockets being separated from each other by means of transverse seams 23, such as welded seams. Each casing/pocket contains at least one, and preferably only one, helical coil spring 24. The springs may have a spiral turn with a diameter of approximately 2 to 10 cm, and preferably 6 cm.

However, as discussed above, other types of mattresses are also possible to use in the above-discussed bed arrangement.

In one embodiment, illustrated in FIGS. 8 and 9, the pocket mattress is an integrated, continuous mattress, extending over the entire width and length of the bed arrangement, and over both zones with variable firmness and zones without variable firmness.

A firmness controlling apparatus 1 as discussed above is arranged beneath a zone of the mattress 2. The firmness controlling apparatus shown in FIGS. 8 and 9 is of the type discussed in relation to FIGS. 6 and 7, but any of the embodiments discussed in the foregoing may be used.

The firmness controlling apparatus 1 may be loosely arranged on a bed bottom (not shown), and with the mattresses then being loosely arranged on top of the bed bottom and on the firmness controlling apparatus. However, the firmness controlling apparatus may alternatively be connected to the bed bottom, or other parts of the bed, and/or to the mattress. Connection to the bed bottom or bed frame can be made by adhesive, bolts, etc. Connection to the mattress may be realized by adhesive, sewing, etc.

When the elongate springs of the firmness control apparatus are contracted, to extend upwards as arcs, as shown in FIG. 9, the springs in the mattress overlying the arcs will be compressed, and will consequently become firmer.

Figure 10:
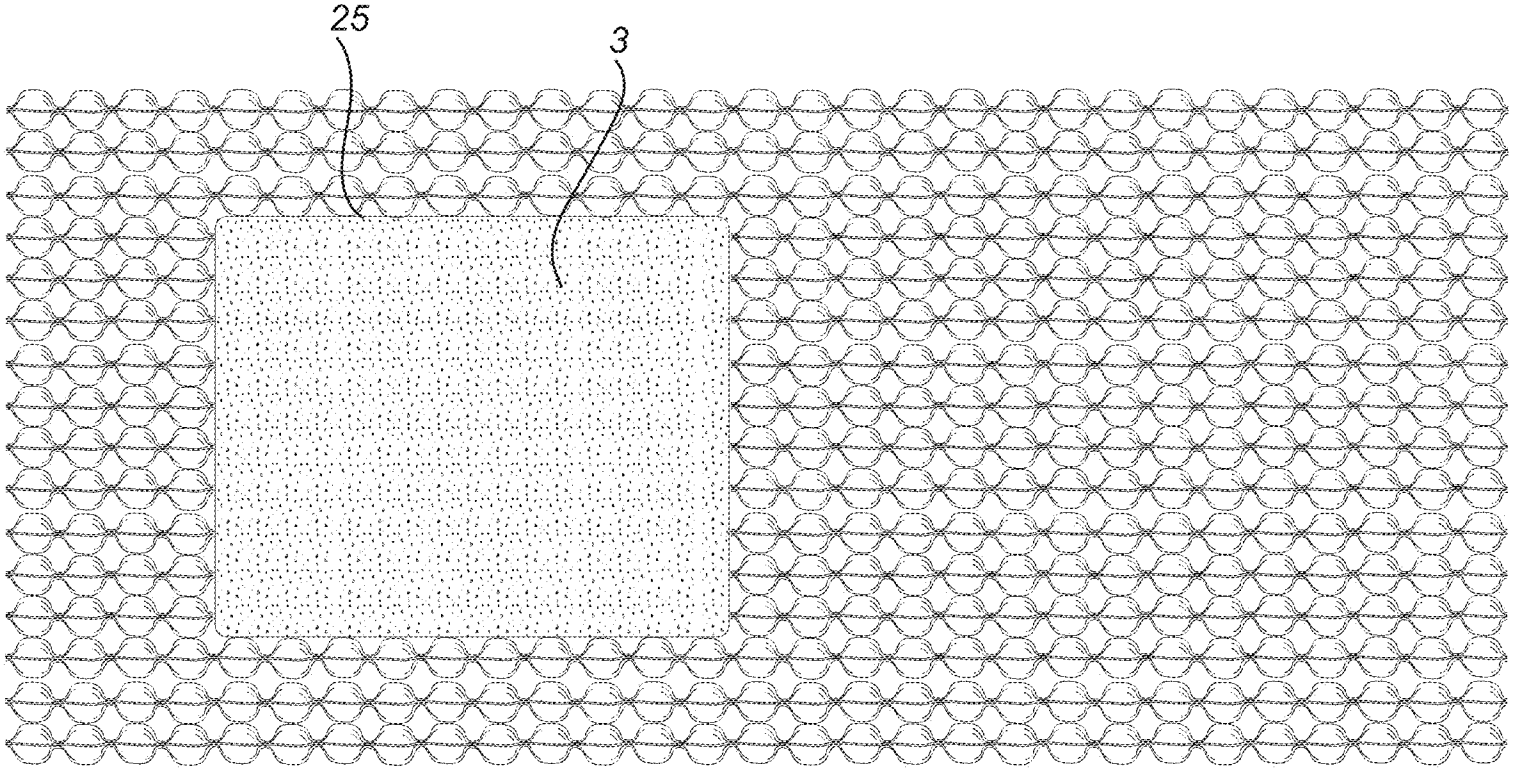
FIG. 10 shows a top view of a bed arrangement in accordance with an embodiment of the present invention.

In another embodiment, as shown in FIG. 10, the mattress comprises at least one cut-out portion 25 arranged overlying the firmness controlling apparatus. The cut-out portion is preferably entirely surrounded by the pocket spring mattress, so that at least one or more rows of pockets are arranged on each side of the cut-out portion in the width direction. The cavity formed by this cut-out portion may be filled by a mattress inlay 3. This mattress inlay may e.g. also be a pocket spring mattresses, but e.g. having different properties, such as being softer than the surrounding pocket spring mattress. However, preferably the mattress inlay is a different type of mattress, such as a foam mattress.

Figure 11:
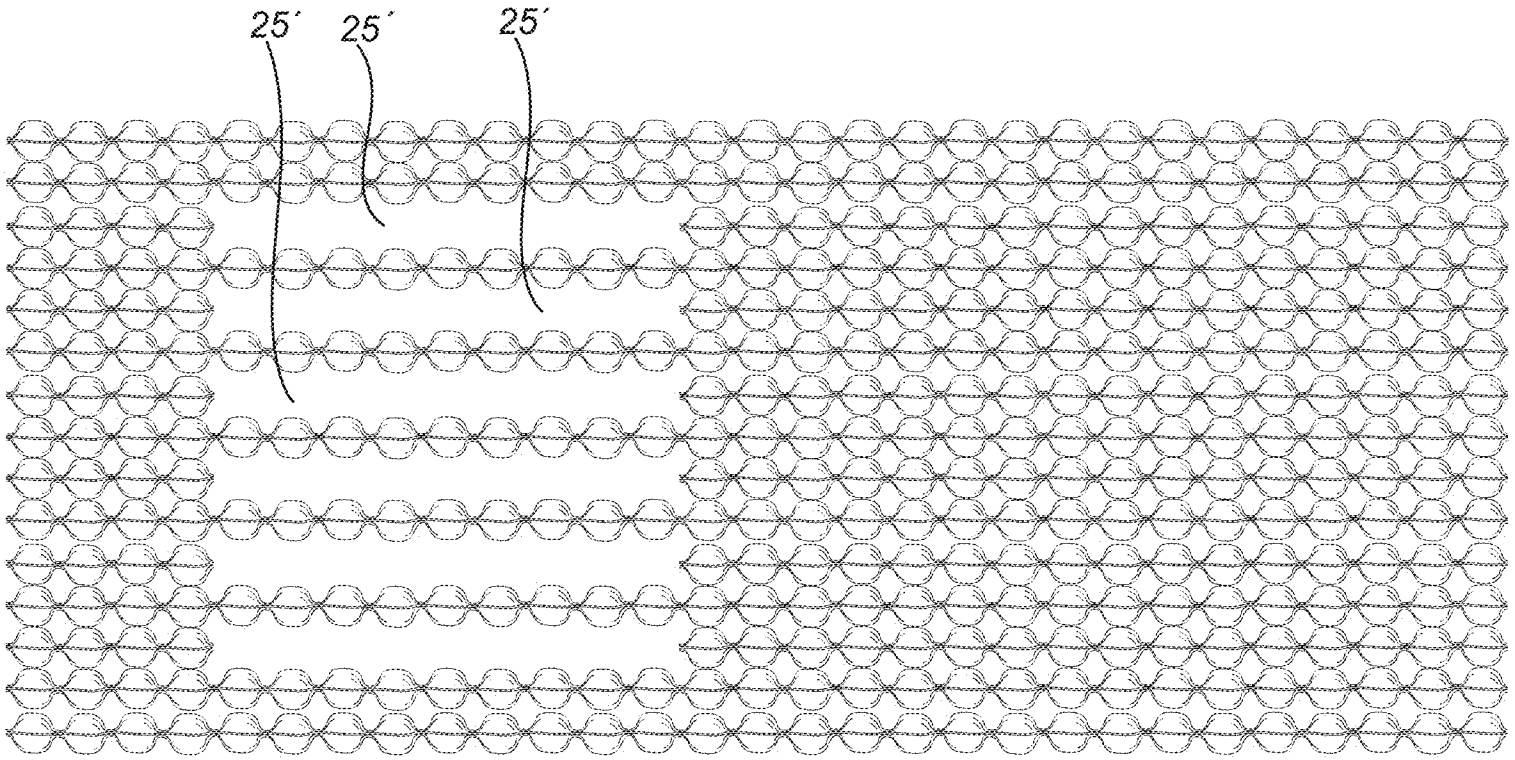
FIG. 11 shows a top view of a bed arrangement in accordance with another embodiment of the present invention.

In an alternative embodiment, as illustrated in FIG. 11, a plurality of cut-out portions 25' are provided. Here, the cut-out portions are elongate, and arranged side-by-side, and arranged essentially only to overly the elongate springs of the underlying firmness controlling apparatus. The cut-out portions are preferably of a size corresponding to the width of one pocket, allowing the cut-out portions to be formed within single strings, and to be surrounded by adjacent neighbouring strings.

In this embodiment, the cavities formed by the cut-out portions need not be filled. Thus, when the elongate springs of the firmness controlling apparatus is relaxed, the cavities of the pocket spring mattress will be empty. Hereby, the firmness of the mattress in the zone having variable firmness is only provided by the remaining pocketed springs arranged between the cut-out portions. Hence, this zone will in this state be softer than the other zones of the mattress. However, when the elongate springs of the firmness controlling apparatus are contracted, the arcs then formed will raise into the cavities formed cut-out portions, thereby partly or fully filling the cavities. The firmness will thereby gradually increase when the elongate springs are contracted, and the firmness of the variable zone will then be provided both by the elongate spring arcs and by the pocketed springs between the cut-out portions. In such a state of increased firmness, the variable zone may have greater or much greater firmness compared to the non-variable zones.

A top layer of padding, fabric or the like may be arranged on top of the mattress, thereby making the cut-out portions invisible and less noticeable.

Figure 12:
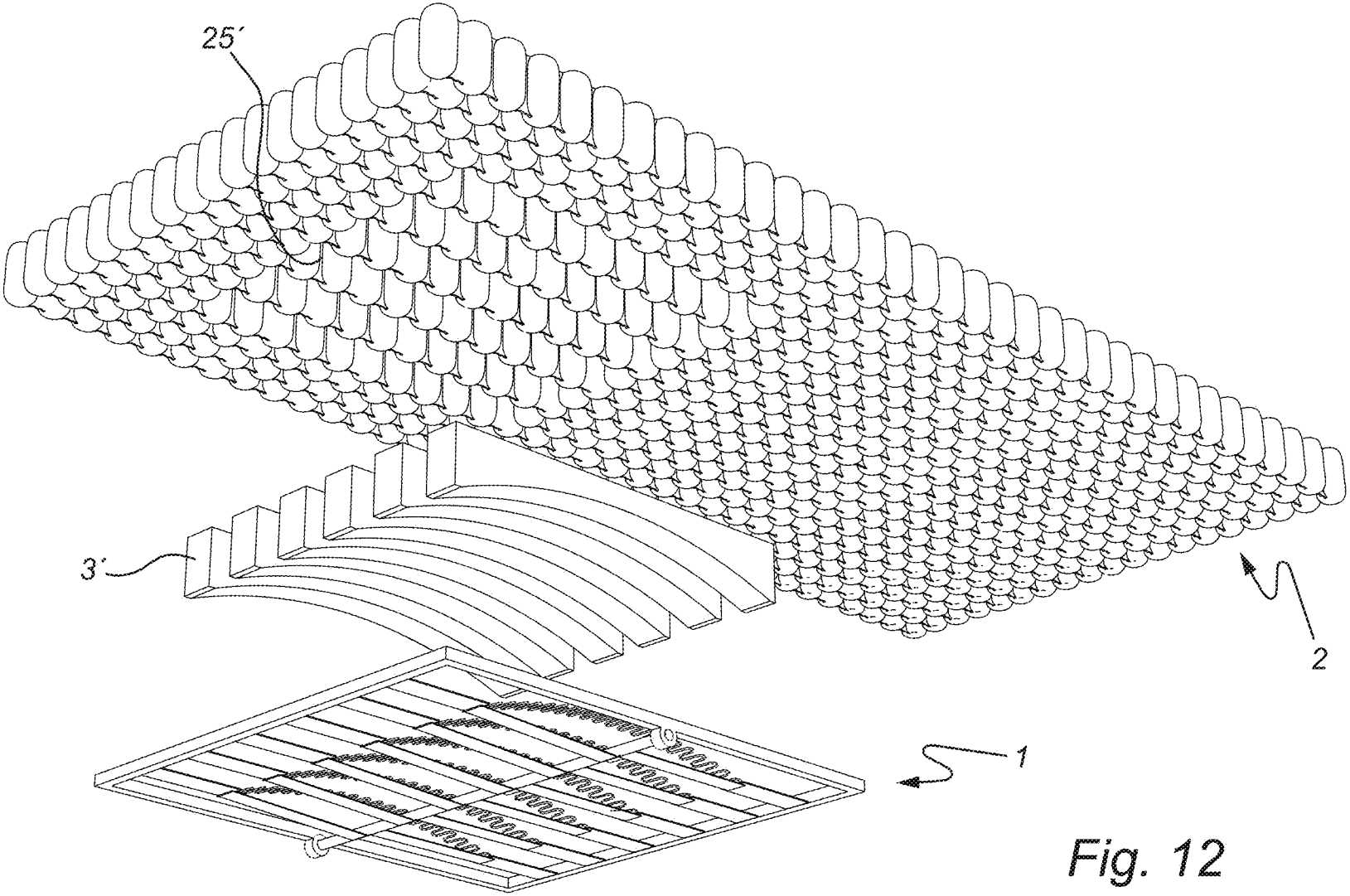
FIG. 12 shows a schematic exploded view in perspective from below of a bed arrangement in accordance with yet another embodiment of the present invention.

However, in order to increase the smoothness of the surface of the mattress, it is also possible to provide mattress inlays 3' also in these cut-out portions 25', as shown in FIG. 12. The inlays may, as discussed above in relation to FIG. 10, e.g. also be a pocket spring mattresses, but e.g. having different properties, such as being softer than the surrounding pocket spring mattress. However, preferably the mattress inlay is a different type of mattress, such as a foam mattress.

It is also preferred that the inlays 25' are here provided with interior surfaces, facing the elongate springs of the underlying firmness controlling apparatus, which are concavely curved, so that the inlays are thicker at the ends thinner in the central part, and with a gradual, curved transition there between. The concave curvature preferably corresponds to the shape of the arc of the corresponding elongate spring, when raised to a corresponding height.

The inlays make the upper mattress surface smoother and more even. In addition, the inlays also provide at least a slight increase of the firmness of this part of the mattress, and also distribute the increased firmness provided by the elongate springs, when raised to arcs.

In the exemplary embodiment illustrated in FIG. 12, the inlays with curved interior surfaces are provided as elongate inlays, provided in the elongate cut-out portions 25' formed between strings of the pocket spring mattress.

However, it is also possible to provide the same type of concavely curved interior surface in a larger inlay 3, such as the one discussed in relation to FIG. 10. Thus, the inlay 3 may here have such an interior curvature extending over its entire width. However, alternatively, the interior curvature may be provided only at positions overlying the elongate springs of the firmness controlling apparatus, as in the FIG. 12 example, and with a planar, non-curved interior surface there between. Such an inlay may e.g. be provided by using a combination of inlay pieces having a curved interior surface and rectangular solid inlay pieces. Every other inlay piece may then be of the curved type, and every other of the rectangular solid type. The inlay pieces may then be connected together, e.g. by adhesive, to form the inlay.

The person skilled in the art realizes that the present invention by no means is limited to the preferred embodiments described above. On the contrary, many modifications and variations are possible within the scope of the appended claims. For instance, alternative mattress elements are possible to use in the zones, such as resilient elements formed by foam, rubber, coil springs, pocketed coil springs, inflatable elements, and the like. Also, the firmness of the mattress may be controlled manually, or in an automated fashion, using an electrical pump, motor or the like. The bed or seating arrangement may also be fully automated, and be provided with a controller to control the firmness automatically, in dependence of pre-stored preferences and/or based on sensor data.

The invention claimed is:

1. A firmness controlling apparatus for use in a bed arrangement or a seating arrangement, the firmness controlling apparatus comprising:

a rigid frame having two opposed sides;

at least one non-elastic flexible elongate element extending between the two opposed sides, each non-elastic flexible elongate element being provided with two ends, wherein each end of the non-elastic flexible elongate element is directly or indirectly connected to one of the opposed sides, and wherein at least one of the ends of each non-elastic flexible elongate element is indirectly connected to one of the opposed sides via an elastic flexible elongate element;

a plurality of elongate springs extending in a flat or curved plane, each elongate spring having two ends, the ends of each elongate spring being attached to one of the at least one non-elastic flexible elongate elements at two separated connections; and a retraction device arranged to tighten and slack the non-elastic flexible elongate element(s) between said two separated connections, thereby adjusting the distance between the two separated connections of each non-elastic flexible elongate element, and thereby controlling the curvature and height of the elongate springs, wherein both ends of each non-elastic flexible elongate element are indirectly connected to one of the opposed sides via elastic flexible elongate elements.

2. The apparatus of claim 1, wherein the non-elastic flexible elongate element(s) is/are straps made of non-elastic flexible fabric.

3. The apparatus of claim 1, wherein the elastic flexible elongate element(s) is/are straps made of elastic flexible fabric.

4. The apparatus of claim 1, wherein the retraction device is arranged beneath a plane in which the non-elastic flexible elongate element(s) extend.

5. The apparatus of claim 1, wherein the retraction device is arranged essentially in a plane in which the non-elastic flexible elongate element(s) extend.

6. The apparatus of claim 1, wherein the retraction device is arranged to tighten the non-elastic flexible elongate element(s) by at least one of: rolling up the flexible elongate element(s) around an axle; and pulling the flexible elongate element(s).

7. The apparatus of claim 1, wherein the retraction device is operated by at least one of an electric motor and an electric pump.

8. The apparatus of claim 1, wherein the elongate springs are at least one of: sinuous springs, no-sag springs, strip springs, and strip steel springs.

9. A bed or seating arrangement, comprising at least one firmness controlling apparatus in accordance with claim 1, wherein the arrangement further comprises a mattress, wherein the firmness controlling apparatus(es) is/are arranged underneath the mattress.

10. The bed or seating arrangement of claim 9, wherein the mattress is a pocket spring mattress, comprising a plurality of strings of a casing material, each string defining a plurality of pockets and each pocket comprising a coil spring.

11. The bed or seating arrangement of claim 9, wherein the mattress comprises at least one cut-out portion arranged overlying the firmness controlling apparatus.

12. The bed or seating arrangement of claim 11, further comprising a foam insert arranged within said at least one cut-out portion, and overlying the firmness controlling apparatus.

13. The bed or seating arrangement of claim 12, wherein the foam is provided with one or several concavely curved interior surfaces overlying the elongate springs of the firmness controlling apparatus.

14. The bed or seating arrangement of claim 9, further comprising at least two zones having variable firmness, and at least one firmness controlling apparatus provided at each zone.

15. The bed or seating arrangement of claim 9, wherein the firmness controlling apparatus has a width extension exceeding 50% of the width of the mattress, and a length extension being less than 50% of the length of the mattress.

16. The bed or seating arrangement of claim 9, wherein the firmness controlling apparatus has a width extension exceeding 75% of the width of the mattress.

17. The bed or seating arrangement of claim 9, wherein the firmness controlling apparatus has a length extension being less than 25% of the length of the mattress.

* * * * *